US005425327A

United States Patent [19]

Zirkelbach et al.

[11] Patent Number: 5,425,327

[45] Date of Patent: Jun. 20, 1995

[54] BOAT CANOPY MOUNTING SYSTEM

[75] Inventors: Alan P. Zirkelbach; Albert W. Zirkelbach, both of Bradenton; Donald A. Zirkelbach, Sarasota, all of Fla.

[73] Assignee: Aldon Industries, Inc., Bradenton, Fla.

[21] Appl. No.: 213,992

[22] Filed: Mar. 14, 1994

Related U.S. Application Data

[63] Continuation of Ser. No. 914,247, Jul. 15, 1992, abandoned.

[51] Int. Cl.[6] ..... B63B 17/00

[52] U.S. Cl. ..... 114/361

[58] Field of Search ..... 114/343, 361, 362; 135/87, 88

[56] References Cited

U.S. PATENT DOCUMENTS

| | | | |
|---|---|---|---|
| Re. 26,363 | 3/1968 | Mills | 114/361 |
| 622,220 | 4/1899 | Goldsborough . | |
| 2,937,652 | 5/1960 | Zimmer et al. | 114/361 |
| 2,961,725 | 11/1960 | McGee | 114/361 |
| 2,975,496 | 3/1961 | McGraw | 24/201 |
| 3,038,225 | 6/1962 | Ausnit | 24/201 |
| 3,068,939 | 12/1962 | Commisso | 160/392 |
| 3,172,419 | 3/1965 | Lewis | 114/361 |
| 3,345,709 | 10/1967 | Bearman | 24/208 |
| 3,364,530 | 1/1968 | Kraus | 24/201 |
| 3,373,464 | 3/1968 | Ausnit | 24/201 |
| 3,486,788 | 12/1969 | Benton | 114/361 |
| 3,595,949 | 7/1971 | Staller | 264/146 |
| 3,918,131 | 11/1975 | Ausnit | 24/201 C |
| 4,046,408 | 9/1977 | Ausnit | 285/188 |
| 4,074,492 | 2/1978 | Simpson et al. | 52/419 |
| 4,199,845 | 4/1980 | Ausnit | 24/201 C |
| 4,268,938 | 5/1981 | Walchli | 24/201 C |
| 4,354,541 | 10/1982 | Tilman | 150/3 |
| 4,372,014 | 2/1983 | Simpson | 24/201 C |
| 4,578,813 | 3/1986 | Ausnit | 383/65 |
| 4,660,259 | 4/1987 | Ausnit | 24/587 |
| 4,673,383 | 6/1987 | Bentsen | 493/381 |
| 4,731,911 | 3/1988 | Gould | 24/587 |
| 4,787,880 | 11/1988 | Ausnit | 493/213 |
| 4,792,240 | 12/1988 | Ausnit | 383/63 |
| 4,846,585 | 7/1989 | Boeckmann et al. | 383/5 |
| 4,878,763 | 11/1989 | Ausnit | 383/65 |
| 4,898,492 | 2/1990 | Janowski | 403/340 |
| 4,939,819 | 7/1990 | Moyer | 24/16 R |
| 4,944,072 | 7/1990 | Robson | 24/587 |
| 5,070,584 | 12/1991 | Dais et al. | 24/587 |
| 5,215,032 | 6/1993 | Ellis et al. | 114/361 |

FOREIGN PATENT DOCUMENTS 1092452 11/1964 United Kingdom .

*Primary Examiner*—Stephen Avila

*Attorney, Agent, or Firm*—Howard & Howard

[57] ABSTRACT

The present invention is a boat canopy mounting system for securing a boat canopy to a boat. The system includes a first member such as a header for attachment to the boat. The first member includes at least one channel having a restricted opening. The second member is adapted to be attached to a boat canopy and has at least one locking flange for insertion into the channel of the first member. The boat canopy can be repeatably connected to and disconnected from the boat by positioning the second member against the channel of the first member and pressing against the second member to force the flanges into the channel. The second member is removable from the channels by pulling the second member away from the channels to disengage the flanges from the channels.

17 Claims, 2 Drawing Sheets

BOAT CANOPY MOUNTING SYSTEM

This is a continuation of application Ser. No. 07/914,247 filed on Jul. 15, 1992, now abandoned.

BACKGROUND OF THE INVENTION

The present invention relates to an improved canopy mounting system for a boat and more particularly to a mounting system that uses a receiving channel to which is attached a canopy having locking tabs thereon. The present invention discloses a mounting system that is easy to use, easy to install, long lasting and watertight.

Typically, a boat canopy is attached to the windshield of a boat by using snaps. A series of spaced male snap portions are secured to the boat header and an equal number of spaced female snap portions are secured to the edge of the boat's canopy. Various examples of snap fasteners are disclosed in U.S. Pat. Nos. 2,937,652; 2,961,725; and 3,367,349.

There are several problems with the use of snaps. One problem is the difficulty in fastening the canopy to the header. On most boats, the canopy has to be pulled tightly in the direction of the header and while keeping tension on the canopy the snaps have to be snapped. Another problem with snaps is their tendency to pull through the canopy because of poor stress distribution. As the canopy is used the snaps begin to pull through the material which eventually requires replacement of the canopy. A further problem is the appearance of the snaps along the header. The snaps are considered by some to be unsightly, especially when used on newer stylish boats with their sleek aerodynamic designs. Further, during installation and use, movement of the snaps can mar the finish of the header which is unacceptable. There is also a problem with galvonic corrosion of the snaps and the header since they are typically made of different metals.

To overcome the problems associated with snaps, there have been attempts to develop snapless systems, but these have met with little success due to inherent problems in their design. One such attempt is disclosed in U.S. Pat. No. 3,304,657 issued in 1967 to Singleton. This mounting system uses a header that has a groove at the top which is adapted to receive the top or canopy. The canopy has a marginal strip that is adapted to fit snugly in the groove with the canopy fabric projecting outwardly from the marginal strip over the header and then rearwardly. A problem with this type of mounting assembly is the need to tuck the marginal strip, which extends across the width of the canopy, underneath the header and into the groove. Inserting the strip in this way is tedious and difficult. Additionally, if the tension on the top is relaxed, the marginal strip can fall out of the grove; therefore, the top must always remain taut.

Another example of a snapless header assembly is disclosed in U.S. Pat. No. 3,172,419 issued in 1965 to Lewis. Lewis is similar to Singleton in that it requires the lateral edge of the canopy to be tucked underneath the header into a groove, a similarly tedious process. Lewis discloses a header that fits on the edge of the boat's windshield and extends outwardly and forwardly of the windshield. A locking channel is formed underneath the outwardly protruding header and includes a rounded portion, an accurate portion and a arcuately shaped lip. A second channel is formed forwardly of the locking channel. This second channel includes a rounded portion, an arcuately shaped lip and a downwardly facing shoulder. A flexible locking strip is provided for insertion into the locking channel and the second channel. The flexible strip has a generally arcuate portion ending in a downwardly turned lip portion and an inwardly projecting rib.

To fasten the canopy to the windshield, the front edge of the canopy is pulled forwardly and stretched over the upper edge of the windshield. The flexible lip portion is flexed downwardly and outwardly to allow it to be tucked under the header and pushed into the locking channel sufficiently so that the lip portion is received in the rounded portion and overlaps the upper edge of the locking channel lip. Upward pressure and backward pressure is then applied to the lip and canopy to allow the rib to enter the outer edge of the second channel and engage the shoulder.

As stated earlier, fastening a boat top to the windshield using the Lewis method is tedious and relatively difficult. It should be remembered that the flexible locking strip extends across the width of the canopy and therefore the entire length of the locking strip must be tucked underneath the header and pushed into the locking channel. Also, as with Singleton, the top must remain tensioned with respect to the header to keep the lip in place and the top fastened. A further disadvantage is that the header is unsightly. In order to get the necessary leverage to fasten the canopy, Lewis requires the locking portion to extend outwardly from the windshield. This design is unacceptable on today's sleek boats.

SUMMARY OF THE INVENTION

The present invention provides a mounting system and a method for mounting a boat canopy to a boat and particularly the windshield of a boat that does not have the problems encountered in the above mounting assemblies. The mounting system and the mounting method allow for easy and quick fastening and removal of a boat canopy. Additionally, the boat canopy does not have to be taut to remain fastened to the header as does the above systems. The invention also can be quickly and easily adapted for use with other fastener types if desired.

Briefly, the present invention allows a boat canopy to be attached by merely placing the edge of the canopy against the boat header and pressing along the edge to fasten the canopy to the header. The canopy has at least one and preferably two flanges that extend along the width of the edge and are adapted to be received within one, but preferably two mating channels formed in the header. The flanges, once received, are locked in the channels and can only be removed by pulling them away from the channels in a direction substantially perpendicular to the channels.

The boat canopy fastening assembly of the present invention includes a header assembly for attachment to the top edge of a boat windshield. Preferably, this header assembly is extruded aluminum and includes a cap portion and a pair of legs extending downwardly from the cap portion.

The exterior side of the cap portion includes at least one and preferably two fastening channels for fastening the boat canopy to the windshield. Preferably, the fastening channels are substantially parallel to the windshield of the boat and extend about the perimeter of the windshield. The fastening channels are adjacent one another and each channel has a restricted opening defined by a locking finger that partially closes the channel.

A locking tab is mounted to the edge of the canopy and is adapted to be locked into the fastening channels by merely pressing along its length. One edge of the locking tab has locking flanges for insertion into the fastening channels of the header. The locking flanges are designed to mate with the fastening channels with each of the locking flanges have a locking recess for receipt of the locking finger of the channel.

The boat canopy can be repeatably connected to and disconnected from the windshield. To connect the canopy, the locking flanges are positioned against the channels and pressed along the length of the locking tab to force the locking flanges into the fastening channels. The locking tab can be removed from the fastening channels by pulling one or both ends of the tab away in a direction substantially perpendicular to the header to disengage the flanges from said channels.

The present invention provides an improved canopy fastening system that makes fastening of the canopy to the windshield quick and easy and provides a very sleek relatively concealed fastening system. As should be appreciated by those of ordinary skill in this field, the fastening system of this invention is not limited to a header, but could be used to replace other types of fasteners on a boat. As for example, an extrusion could be made in the form of a rail to be mounted to the deck of the boat for receipt of another portion of the canopy.

DETAILED DESCRIPTION OF THE INVENTION

Figure 1:
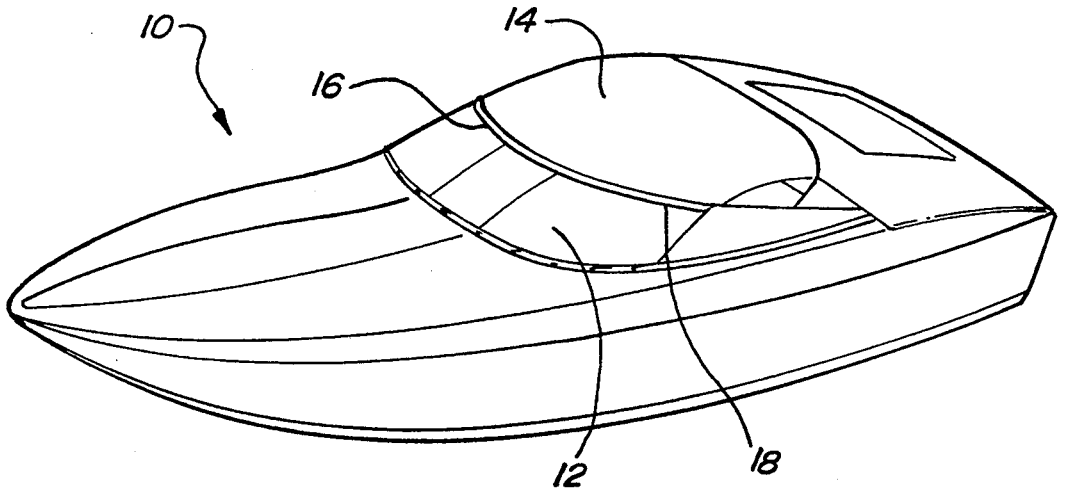
FIG. 1 is a perspective view of a boat with the snapless fastener system of the present invention.

With reference to FIG. 1, a boat 10 is illustrated having a windshield 12, a canopy 14, header 16 and locking tab 18 of the present invention. Briefly, the boat canopy 14 of the present invention can be attached to the header 16 by positioning locking tab 18 against the exterior face of header 16 and pressing along tab 18.

Figure 2:
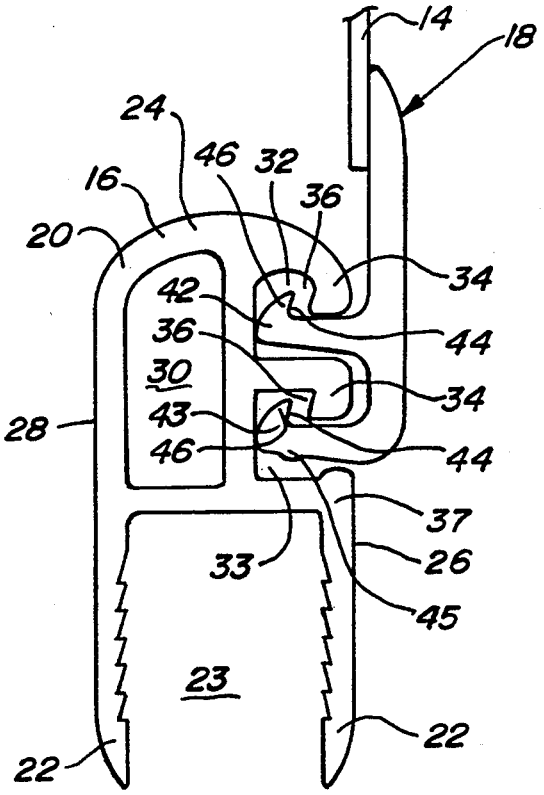
FIG. 2 is a cross-sectional view of the snapless fastener system of the present system taken along line 2—2 of FIG. 1.
Figure 3:
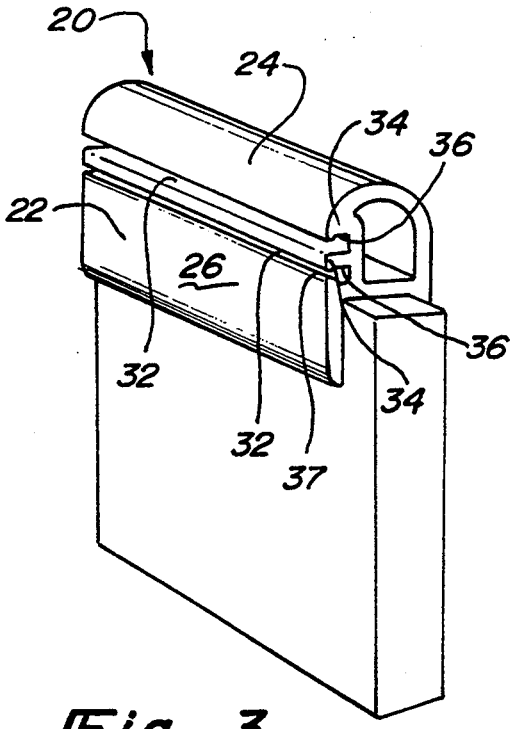
FIG. 3 is a perspective view of the header of the present invention.

With reference to FIGS. 2 and 3, the preferred embodiment of the header 16 and locking tab 18 of the present invention will be described in greater detail. FIG. 2 illustrates the locking tab 18 fastened to the header 16. Preferably, the header assembly 16 is extruded aluminum but could be made of other materials, such as for example, plastic, rolled stainless steel or fiberglass. The header 16 includes a cap portion 20 and a pair of legs 22 extending downwardly from the cap portion 20. The legs 22 are spaced apart to form a channel 23 for receipt of the top edge of the boat windshield 12. The legs 22 are adapted to grip the boat windshield.

In the preferred embodiment the cap portion 20 has a rounded top 24, an exterior side 26 facing the bow or generally outboard of the boat 10 and an interior side 28 facing the interior of the boat 10. As illustrated, the interior 30 of the cap portion is hollow to reduce the amount of material used and to create a cavity through which wire can be routed.

The exterior side 26 of cap portion 20 includes at least one and preferably two fastening channels 32 and 33. Preferably, the fastening channels 32 and 33 are in a plane that is substantially parallel to the windshield of the boat and extend about the perimeter of the windshield. Each of the channels 32 and 33 has a restricted opening defined by a locking finger 34 that partially closes the respective channels 32 and 33 and forms a re-entrant groove 36. Additionally, channel 33 of the preferred embodiment includes a retaining lip 37 to facilitate retention of the locking tab 18. This will be discussed n greater detail below.

The locking tab 18 is fastened to the edge of the canopy 14 by for example, stitching, dielectrically welding, or adhesively attaching the edge of the tab to the canopy 14, or by other known connecting means. In the preferred embodiment, the locking tab is made of a relatively flexible plastic such as for example PVC, polyethylene, or polyurethane.

With reference to FIG. 2, the locking tab 18 has locking flanges 42 or 43 for insertion into the fastening channels 32 and 33 of the header 16. The locking flanges 42 or 43 are designed to mate with the fastening channels 32 and 33. Each of the locking flanges 42 has a general hook snap defining a locking recess 44 for receipt of locking finger 34 of channels 32 and 33 and a re-entrant protrusion 46 for engagement into the re-entrant groove 36 of the respective channels 32 and 33. As shown, re-entrant protrusion 46 has a thickness greater than the width of the restricted opening. Locking flange 43 also includes a locking lug 45 that further locks tab 18 into header 20. Lug 45 engages restraining lip 37 to assist in retaining tab 18 in header 20.

The boat canopy 14 can be repeatably connected to and disconnected from the windshield 12 of the boat 10.

To connect the canopy, the locking flanges 42 are positioned against the channels 32 and 33 and the length of the locking tab 18 is pressed to force the locking flanges 42 into the fastening channels 32. The locking tab 18 can be removed from the fastening channels 32 and 33 by pulling the tab 18 away in a direction substantially perpendicular to the header 16 to disengage the flanges 42 and 43 from the channels 32 and 33.

As should be appreciated by those of ordinary skill in the art, when in use, the canopy 14 of the boat 10 will normally pull upwardly and rearwardly on the locking tab 18 and the header 16. Flanges 42 and 43 cooperate with channels 32 and 33 and the locking fingers 34 in cooperation with the locking recesses 44 resist this pulling force. Additionally, lug 45 engages lip 37 to further resist removal by rearward pulling of the canopy.

Figure 4:
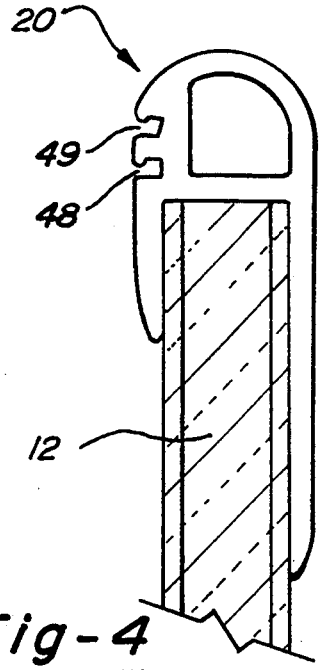
FIG. 4 is a cross-sectional view of a further embodiment of the header of the present invention.
Figure 5:
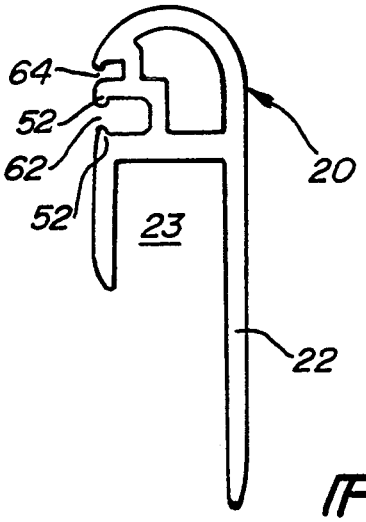
FIG. 5 is a cross-sectional view of a further embodiment of the header of the present invention.

With reference to FIGS. 4 and 5, further embodiments of the header of the present invention are illustrated. The locking tabs for these embodiments are not illustrated but it should be appreciated that the flanges on the locking tab would mate with the channels in the respective header assemblies 16 of these figures. With reference to FIG. 4, the upper channel 49 is slightly angled with respect to the lower channel 48. The position of the upper channel 49 receives the force of the upper flange more squarely against the re-entrant groove which resists the pull of the canopy.

In FIG. 5, the lower flange 62 is larger than the upper flange 64. The lower flange includes two locking fingers 52 that are adapted to be received within mating locking recesses in the locking tab. The lower most locking finger 52 would function in a manner similar to retaining lip 37 discussed above.

Figure 6:
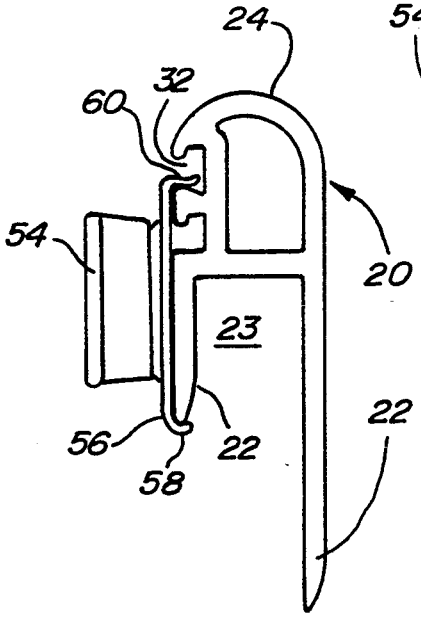
FIG. 6 is a cross-sectional view of the header of the present invention employing a snap.
Figure 7:
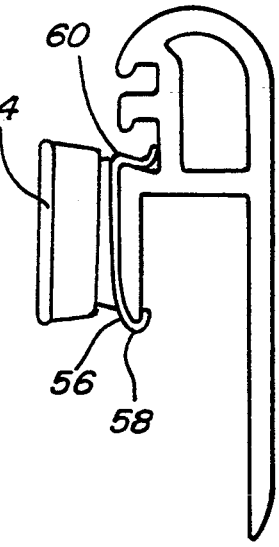
FIG. 7 is a cross-sectional view of a further embodiment of the header of the present invention employing a snap.

With reference to FIGS. 6 and 7, another embodiment of the present invention is shown. In this embodiment, the header receives a standard snap 54. As should be appreciated, the snap 54 is adapted to receive a female snap member, not shown. The male portion 54 of the snap as illustrated includes a mounting bracket 56 with turned in edges 58 and 60 that permit the bracket or clip to be snapped into place about the end of leg 22 and one wall of the channel 32. To install the snap 54 edge 58 is positioned about the end of leg 22 and the snap is pivoted until edge 60 snaps into place against the wall of channel 32. As can be seen in FIGS. 6 and 7, the wall of channel 32 that receives the edge 60 is slightly relieved to form an inclined surface that inclines away from the opening of the channel 32. As should be appreciated, the force on the snap 54 will normally be directed upwardly and rearwardly. This force will be resisted by the edge 58 pulling against the end of leg 22. The direction of the pulling force will also be up and back when the canopy is unsnapped. Since the canopy will be covering the snap, only the bottom edge of the canopy can be grasped to pull the canopy away from the header. This will result in the pulling action being up and back which will be resisted by the edge 58 and end of leg 22.

Figure 8:
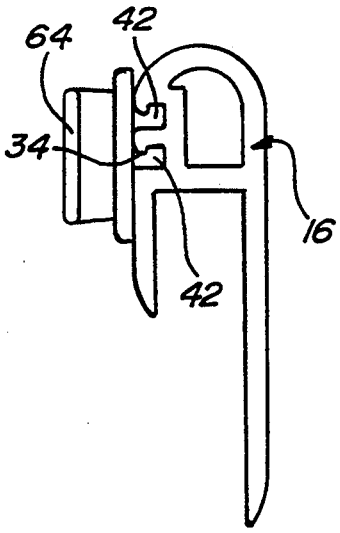
FIG. 8 is a cross-sectional view of a still further embodiment of the header of the present invention employing a snap.

FIG. 8 illustrates a further embodiment of a snap 64 that can be used with the present invention. Snap 64 has a back configuration that includes flanges 42 that mate with the channels 32 of the header 16. In this embodiment, the flanges 42 are prevented from being pulled from the channels 32 when the canopy is unsnapped from the header by the interaction of the locking finger 34 in the locking recess 44.

Having described various preferred embodiments of the present invention, it should be realized by one of ordinary skill in the art that the snapless canopy of the present invention may be modified without departing from the inventive concepts as set forth in the following claims.

What is claimed is:

1. A boat canopy retaining assembly for retaining a boat canopy to the windshield of a boat, said retaining assembly comprising:

a header for attachment to the top edge of a boat windshield, said header including a pair of legs extending therefrom, said legs being adapted to grip said boat windshield;

said header including fastening means for fastening a boat canopy along said windshield, said fastening means extending along the exterior side of said header for at least the majority of the top edge, and facing toward the outboard of said boat, said fastening means including two channels with one of said channels including a locking tab partially closing said channel and the other of said channels including two opposed locking tabs partially closing said channel;

a resilient canopy locking member adapted to be attached to a boat canopy, said canopy locking member including resilient locking flanges for insertion into said channels, each of said locking flanges having a locking recess for receipt of said locking tabs of said channels;

whereby a boat canopy can be repeatably connected to and disconnected from said windshield by attaching the boat canopy to said locking tab and thereafter forcing said locking flanges into said channels of said header by positioning said locking flanges adjacent to said channels and thereafter pressing against said canopy locking member to force said flanges into said channels, said canopy locking member being removable from said channels by pulling said canopy locking member away from said header to disengage said flanges from said channels.

2. The boat canopy retaining assembly of claim 1, wherein said header includes a cap portion having a top, an exterior side and an interior side.

3. The boat canopy retaining assembly of claim 2, wherein said cap portion has a rounded top.

4. The boat canopy retaining assembly of claim 1, wherein said locking member has a main body with said locking flanges extending substantially perpendicular to said main body of said locking member.

5. The boat canopy retaining assembly of claim 1, wherein said header is extruded from aluminum.

6. The boat canopy retaining assembly of claim 1, wherein said locking member is formed of plastic.

7. The boat canopy retaining assembly of claim 1, further including snaps having bases that are configured to be locked into said channel.

8. The boat canopy retaining assembly of claim 1, wherein said restricted opening to said at least one channel has a first width, and a groove being formed inwardly of said restricted opening, said locking flange having a protrusion received in said groove when said canopy is attached to said boat, said protrusion of said locking flange extending for a thickness greater than said first width such that said locking flange snaps through said restricted opening.

9. The boat canopy retaining assembly of claim 1, wherein said locking tab also extends along at least the majority of the top edge of said boat windshield.

10. The snapless boat canopy of claim 1, wherein said locking flanges extend for at least the majority of said channel.

11. A snapless boat canopy fastening assembly for securing a boat canopy to a boat, said assembly comprising:

a first member for attachment to the boat, said first member including at least one channel having a restricted opening, and extending for at least the majority of the perimeter of the portion of the boat to which it is attached said channel being defined by a locking finger partially closing said channel;

a second resilient member adapted to be attached to a boat canopy, said second resilient member having at least one resilient locking flange having a locking recess for receipt of said locking finger of said channel;

said restricted opening of said one channel having a first width, and a groove formed inwardly of said restricted opening, said locking flange having a protrusion adapted to be received in said groove when said canopy is attached to the boat, said protrusion of said locking flange extending for a thickness greater than said first width such that said locking flange snaps through said restricted opening;

whereby a boat canopy can be repeatably connected to and disconnected from said boat by positioning said second resilient member against said channel of said first member and pressing against said second resilient member to force said flange into said channel, said second resilient member being removable from said channel by pulling said second resilient member away from said channel to disengage said flange from said channel.

12. The snapless boat canopy of claim 11, wherein said first member is a header for attachment to the top edge of a boat windshield, said header including a pair of legs extending therefrom, said legs being adapted to grip said boat windshield.

13. The snapless boat canopy of claim 11, wherein said locking member has a main body with said locking flanges extending substantially perpendicular to said main body of said locking finger.

14. The snapless boat canopy of claim 12, wherein said header is extruded from aluminum.

15. The snapless boat canopy of claim 11, wherein said second member is formed of plastic.

16. The snapless boat canopy of claim 11, further including snaps having bases that are configured to be locked into said channel.

17. The snapless boat canopy of claim 11, wherein said first member includes two channels with one of said channels including a locking tab partially closing said channel and the other of said channels including two opposed locking tabs partially closing said channel.

* * * * *